US011492168B2

(12) United States Patent
Diaz

(10) Patent No.: US 11,492,168 B2
(45) Date of Patent: Nov. 8, 2022

(54) INTERCHANGEABLE FOOD BOX TRAY

(71) Applicant: Ariel Diaz, North Miami Beach, FL (US)

(72) Inventor: Ariel Diaz, North Miami Beach, FL (US)

( * ) Notice: Subject to any disclaimer, the term of this patent is extended or adjusted under 35 U.S.C. 154(b) by 184 days.

(21) Appl. No.: 17/064,309

(22) Filed: Oct. 6, 2020

(65) Prior Publication Data

US 2021/0107695 A1 Apr. 15, 2021

Related U.S. Application Data

(60) Provisional application No. 62/913,105, filed on Oct. 9, 2019.

(51) Int. Cl.

| | |
|---|---|
| ***B65D 5/02*** | (2006.01) |
| ***B65D 81/36*** | (2006.01) |
| ***B65D 5/54*** | (2006.01) |
| ***B65D 5/42*** | (2006.01) |
| ***B65D 5/46*** | (2006.01) |

(52) U.S. Cl.

CPC ..... *B65D 5/0227* (2013.01); *B65D 5/4212* (2013.01); *B65D 5/46096* (2013.01); *B65D 5/5405* (2013.01); *B65D 81/36* (2013.01)

(58) Field of Classification Search

CPC .... B65D 5/3621; B65D 5/46128; B65D 5/10; B65D 5/46096; B65D 81/36; B65D 5/0227; B65D 5/4212; B65D 5/5405; A45C 2007/0004; A45F 3/46; A45F 4/02; A47G 23/0303

USPC .... 229/103, 236, 245, 902, 904, 116.1, 117, 229/942; 206/736

See application file for complete search history.

(56) References Cited

U.S. PATENT DOCUMENTS

| | | | | |
|---|---|---|---|---|
| 5,586,659 | A * | 12/1996 | Trumbo | B42D 15/042 206/751 |
| 6,059,179 | A * | 5/2000 | Giampapa | A47G 9/062 229/117.15 |
| 7,845,508 | B2 * | 12/2010 | Rothschild | A45F 4/02 220/4.08 |
| 8,061,896 | B2 * | 11/2011 | Delgado | B65D 33/105 206/549 |
| 2003/0111521 | A1 * | 6/2003 | Holmes | B65D 5/3621 229/117 |
| 2007/0134454 | A1 * | 6/2007 | Broderick | B65D 81/36 428/35.2 |
| 2007/0258662 | A1 * | 11/2007 | Venditti | B65D 81/36 383/207 |

FOREIGN PATENT DOCUMENTS

| | | | | |
|---|---|---|---|---|
| GB | 2436791 | A * | 10/2007 | A45C 11/20 |

* cited by examiner

*Primary Examiner* — Nathan J Newhouse
*Assistant Examiner* — Phillip D Schmidt
(74) *Attorney, Agent, or Firm* — Michael C. Balaguy

(57) ABSTRACT

A method of transforming a meal box into a tray. Many fast-food companies sell children's meals in decorative boxes. These boxes can have games or entertainment printed on the inside and outside of the box. The first step of the method is removing the contents. The next step is cutting, tearing, or otherwise opening the box along a seam between sidewalls of the box, such as along the glue line preexisting on the box.

9 Claims, 6 Drawing Sheets

INTERCHANGEABLE FOOD BOX TRAY

CROSS-REFERENCE TO RELATED APPLICATIONS

This application claims priority to U.S. Provisional Patent Application No. 62/913,105, filed, Oct. 9, 2019, which is incorporated by reference.

BACKGROUND

The following includes information that may be useful in understanding the present disclosure. It is not an admission that any of the information provided herein is prior art nor material to the presently described or claimed inventions, nor that any publication or document that is specifically or implicitly referenced is prior art.

Fast-food establishments commonly serve food in a small box for children. The box is opened, food is retrieved, and the box is often discarded. The food may be set directly on the table surface and be at risk for contacting germs and bacteria.

SUMMARY

Given these disadvantages inherent in the known art, this disclosure provides a novel. One general aspect includes.

A method of transforming a meal or food box into a tray or sanitary tray is disclosed. The box has four walls with corners where two walls connect. In some versions, the box has a glue line at one corner. The bottom pieces of the box connect to the walls and interlock with each other when the box is in a closed configuration. A top with a handle connects to the sides of the box, forming a closed container. The meal is delivered in this box.

The top of the box is opened to remove the contents. Then an opening along one of the corners is created. This opening allows for the box to be unfolded and laid flat, arranging the box on a side with the interior surface pointing up and the exterior surface pointing down to form a tray.

In some versions the box has perforations along some or all of the corners. Sometimes the box has a glue line between two sides, such as between the first and fourth sides, and sometimes the box is opened along the glue line. Once the tray has been created, the user's items (food, toys, etc.) are placed on the sanitary surface of the box's interior rather than on the potentially unsanitary surface of the table or bench.

At that point, the user can eat the food and play with the toys. Afterwards, the tray can be thrown away or retained, as desired.

In summarizing the invention, certain aspects and advantages have been described. The new device or method may be made or carried out in a manner that it achieves or optimizes one set of advantages without necessarily achieving other advantages.

BRIEF DESCRIPTION OF THE DRAWINGS

The figures that accompany the written portion of this specification illustrate variations and methods of use for the present devices.

DETAILED DESCRIPTION

Figure 1:
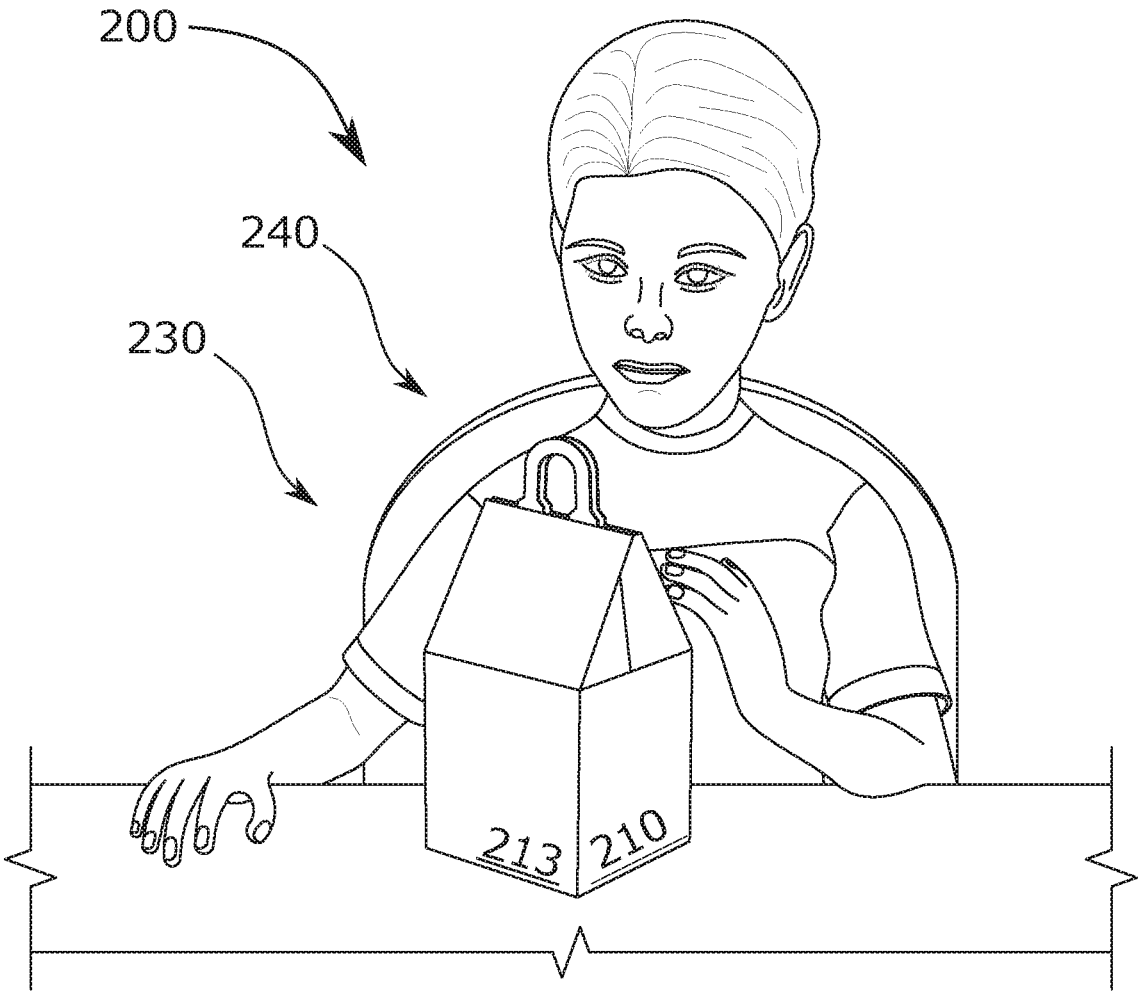
FIG. 1. is a front perspective view of a meal box

Unless defined otherwise, all technical and scientific terms used in this document have the same meanings as commonly understood by one skilled in the art to which the disclosed invention pertains. Singular forms—a, an, and the—include plural referents unless the context clearly indicates otherwise. Thus, for example, reference to "fluid" refers to one or more fluids, such as two or more fluids, three or more fluids, etc. When an aspect is said to include a list of components, the list is representative. If the component choice is specifically limited to the list, the disclosure will say so. Moreover, listing components acknowledges that exemplars exist for each of the components and any combination of the components—including combinations that specifically exclude any one or any combination of the listed components. For example, "component A is chosen from A, B, or C" discloses exemplars with A, B, C, AB, AC, BC, and ABC. It also discloses (AB but not C), (AC but not B), and (BC but not A) as exemplars, for example. Combinations that one of ordinary skill in the art knows to be incompatible with each other or with the components' function in the invention are excluded from the invention, in some exemplars.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on", "directly engaged to", "directly connected to" or "directly coupled to" another element or layer, there may be no intervening elements or layers present. Other words used to describe the relationship between elements should be interpreted in a like fashion (e.g., "between" versus "directly between", "adjacent" versus "directly adjacent", etc.).

Although the terms first, second, third, etc. may be used to describe various elements, components, regions, layers, or sections, these elements, components, regions, layers, or sections should not be limited by these terms. These terms may be only used to distinguish one element, component, region, layer, or section from another region, layer, or section. Terms such as "first", "second", and other numerical terms do not imply a sequence or order unless indicated by the context. Thus, a first element, component, region, layer, or section discussed below could be termed a second element, component, region, layer, or section without departing from this disclosure.

Spatially relative terms, such as "inner", "outer", "beneath", "below", "lower", "above", "upper" and the like, may be used for ease of description to describe one element or feature's relationship to another element or feature as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors interpreted accordingly.

The description of the exemplars has been provided for purposes of illustration and description. It is not intended to be exhaustive or to limit the invention. Individual elements or features of a particular exemplar are generally not limited to that particular exemplar but, where applicable, are interchangeable and can be used in a selected exemplar, even if not explicitly shown or described. The same may also be varied in many ways. Such variations are not a departure from the invention, and all such modifications are included within the invention's scope.

The present invention provides fast-food restaurants with a food packaging entertainment system for children. The system features a small box capable of being converted into a miniature house, utilized as a storage location and play mat area for a child's food, and also utilizes a series of seams and perforations to open the box and convert it into a unique house. This prevents food from ever touching a table in a restaurant, eliminating the worry of contracting germs and bacteria from the table surface, and offers fun and entertainment for a child while he or she enjoys their meal.

The disclosed device is a modified box for food served to children at fast-food establishments. The box is comprised of a house exterior with several perforated edges. Particular edges can be torn away to create a play mat-like area for storing food when eating at a restaurant. The exterior house design is intended to provide children with a form of entertainment while enjoying their food. The house can be opened, and food can be spread along the base area and kept off the table. The box's interior sections can feature puzzles, crosswords, and other fun games for the child to enjoy.

FIG. 1 depicts a user, such as a child, with a packaged meal, such as a fast-food meal and a packaged meal box 200. Packaged meal box 200 is typically printed with scenes or games designed to entertain the child. FIG. 1 calls out several components to help, oriented FIG. 1 to the remaining figures. In addition to box 200, FIG. 1 shows handle 240, top 230, first wall 210, and fourth wall 213

Figure 2:
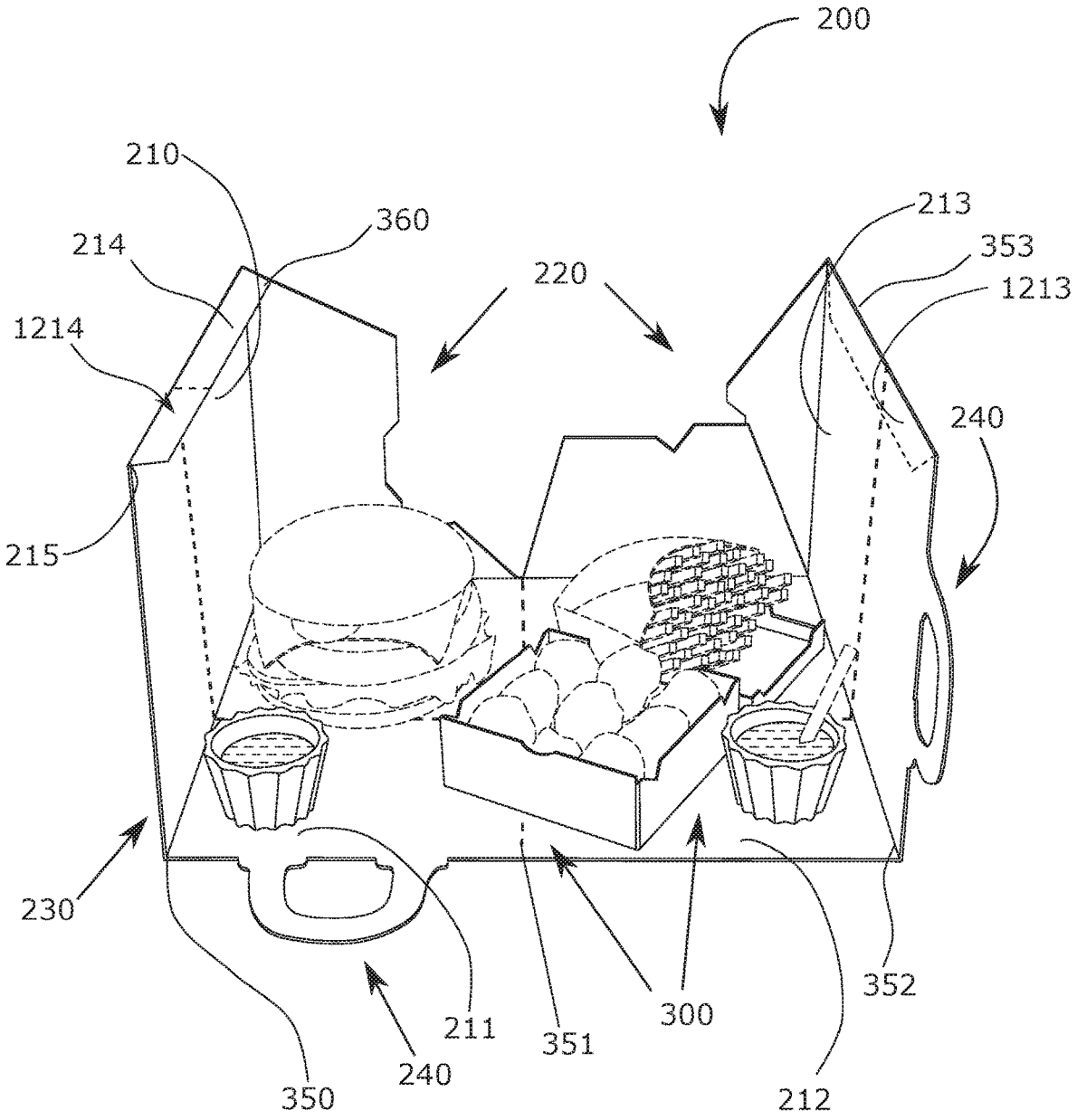
FIG. 2 is a front perspective view of the box of FIG. 1 in a different configuration.
Figure 3:
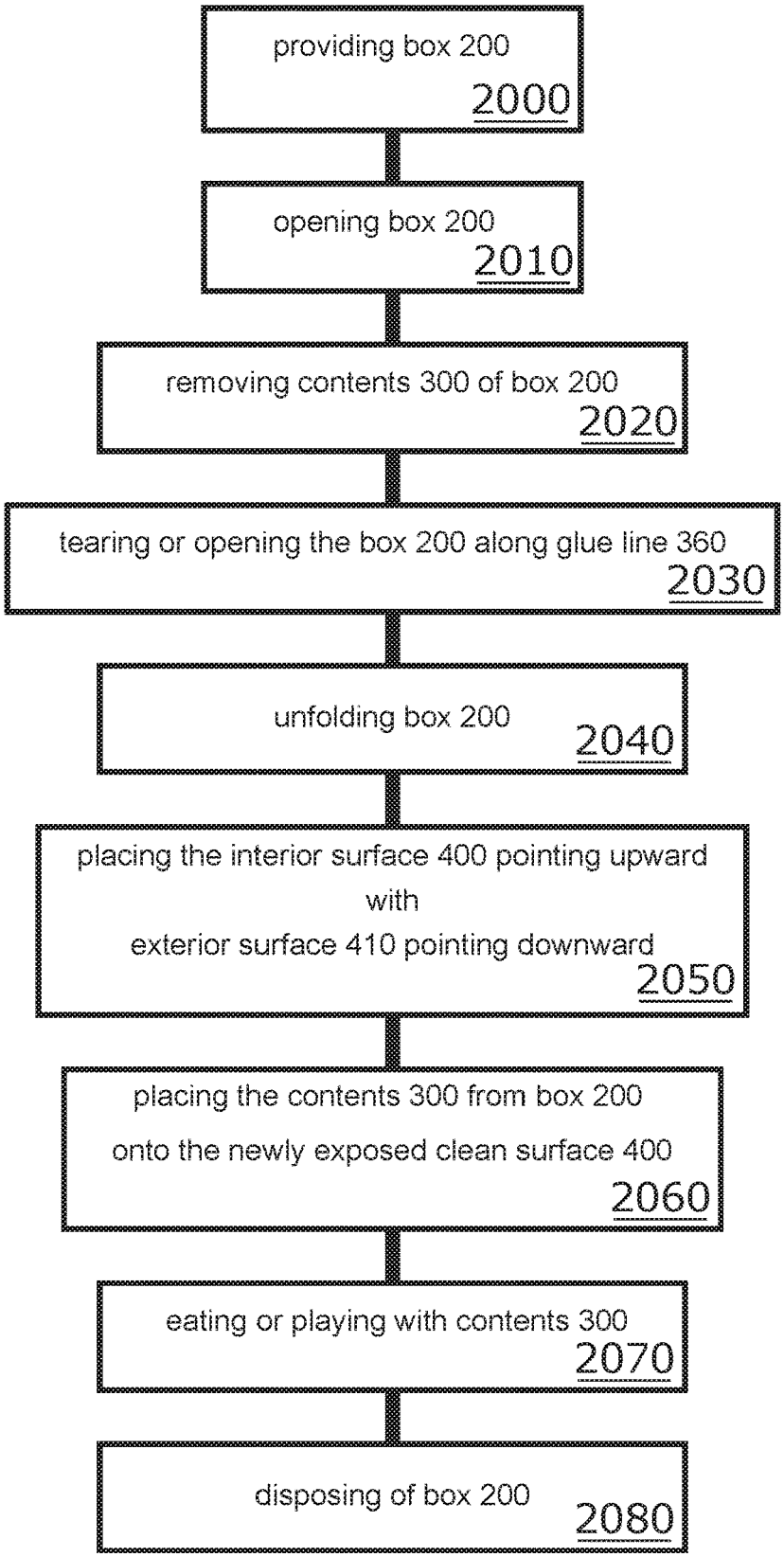
FIG. 3 is a flowchart of a method.
Figure 4:
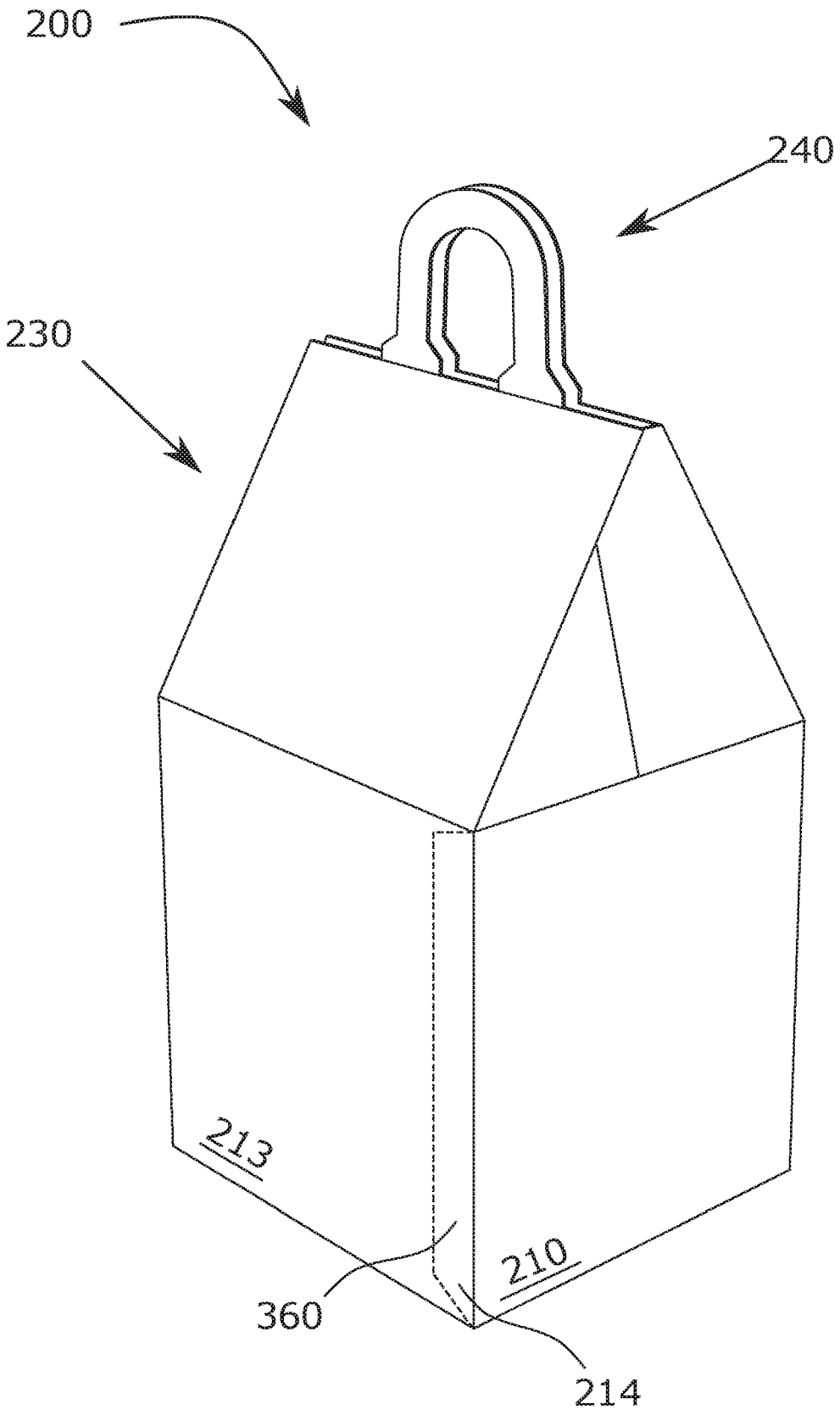
FIG. 4 is a front perspective view of the box of FIG. 1, closed configuration.
Figure 5:
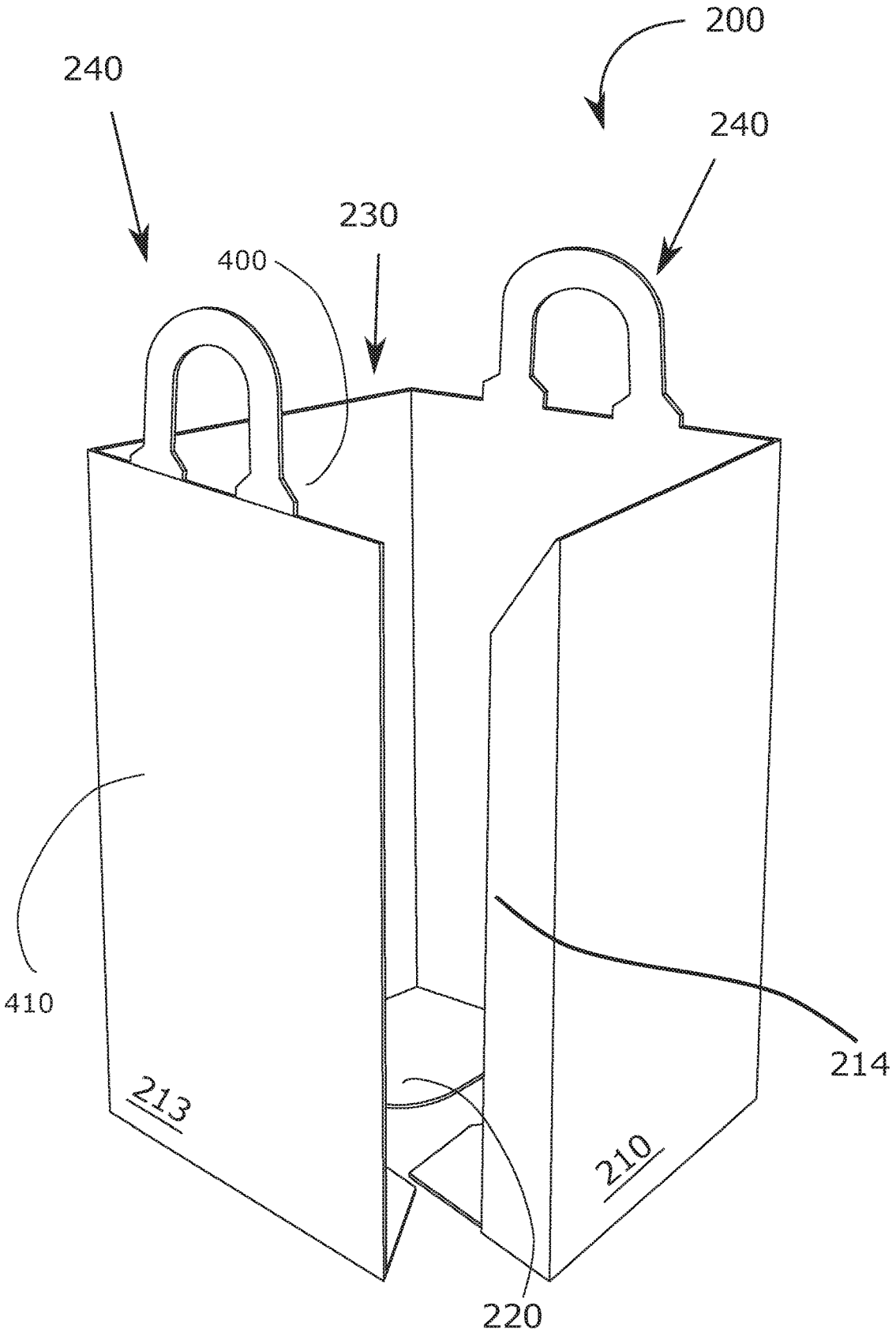
FIG. 5 is a front perspective view of the box of FIG. 1, partially open.
Figure 6:
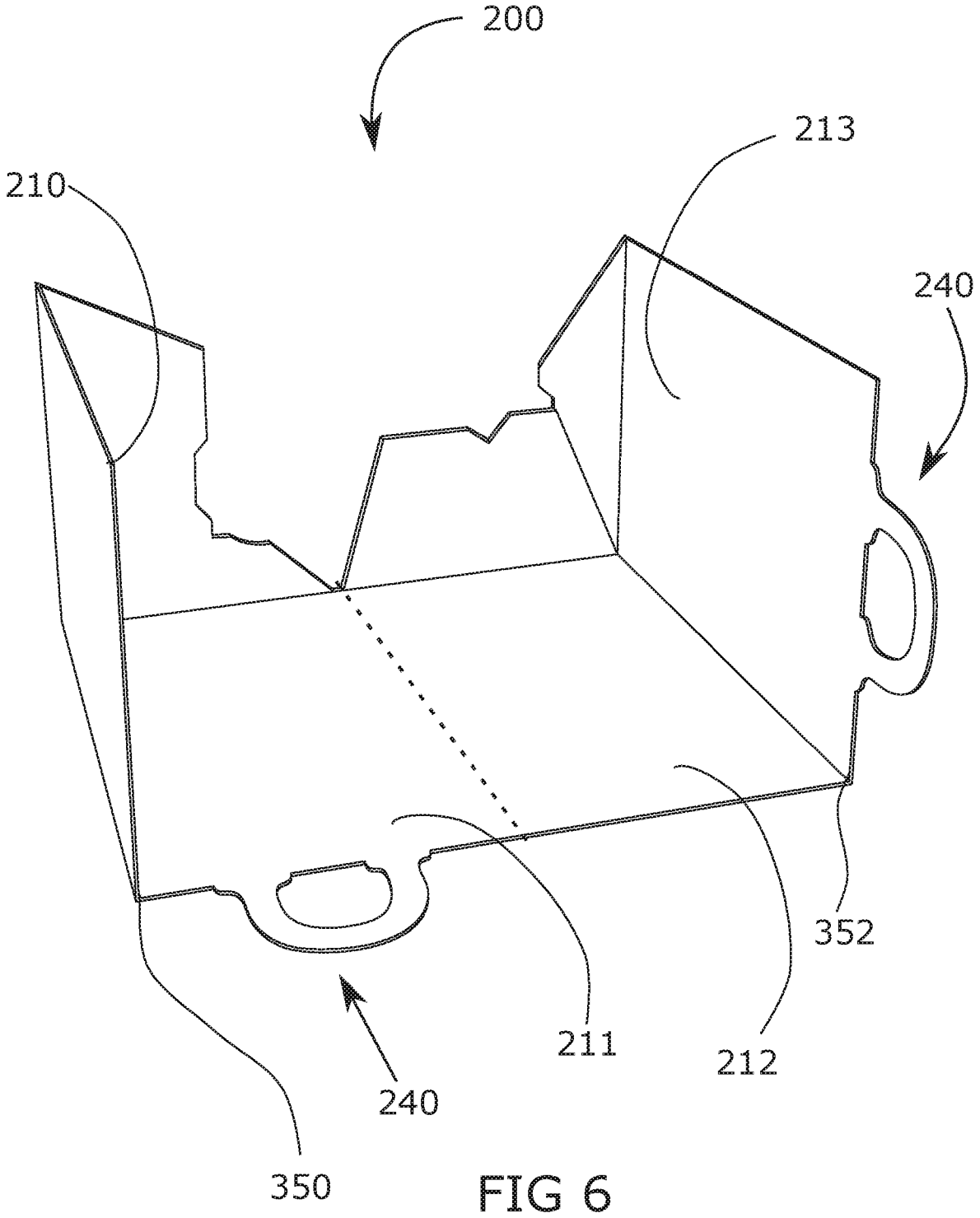
FIG. 6 is a front perspective view of the box of FIG. 1, tray configuration.

FIG. 2 depicts a packaged meal box 200 processed using a tray making method, as disclosed in FIG. 3. FIG. 6 shows an unfolded version of the box in FIG. 5XX acts or the tray configuration of box 200. FIG. 4 shows the closed configuration of box 200. Box contents 300 are shown arranged on second wall 211, and third wall 212, laid flat in the unfolded version of box 200. First wall 210 joins to second wall 211, along corner 350 or connection 350. Second wall 211 joins to third wall 212 through connection 351. Third wall 212 joins to fourth wall 213 through connection 352. Connections 350, 351, 352 are folds in the paper or plastic material used to construct box 200.

First wall 210 joins to fourth wall 213 through glue connection 360. First wall 210 joins to flap 214 through connection 215, which is much like connections 350, 351, 352. Flap 214 has glue region 1214. Fourth wall 213 has glue region 1213 adjacent edge 353 on fourth wall 213.

During production, box 200 is cut from a sheet of paper or plastic with folds, bends, or connections (connections 351, 352, 353, etc.), as desired. In some cases, the connections are manipulated to allow them to bend more easily. The final action is applying glue or other adhesives to glue region 1214 and pressing glue region 1214 against glue region 1213, or vice versa. Thus, the final connection has many of the same properties as the other connections despite being a glue connection.

FIG. 3 depicts a method of creating a sanitary tray or play surface from box 200. The method comprises step 2000, providing the box 200. Step 2000 results in the box situated as shown in FIG. 4.

FIG. 4 depicts the packaged meal box 200 closed or in a closed configuration. This figure shows handle 240, first wall 210, and fourth wall 213. Glue connection 360 runs along the corner where first wall 210 and fourth wall 213 meet. Edge 353 and flap 214 (hidden in this view) are indicated on the figure to help guide the transformation from the closed configuration of FIG. 4 to the open configuration of FIG. 6 (or FIG. 2).

The method also comprises step 2010, opening the top of box 200. The method also comprises step 2020, removing the contents of box 200. The method also comprises step 2030. Once box 200 is empty, it is ready for step 2030. Step 2030 is tearing or opening box 200 along a corner, such as glue line 360, creating a disconnection. This operation results in box 200 being oriented as in FIG. 5. FIG. 5 depicts box 200 in a partially open configuration or orientation. Box 200 has been open along glue line 360, exposing the interior surface 400, bottom pieces 220, and flap 214.

The method also comprises step 2040, unfolding the box 200. Once box 200 has been, unfolded step 2050 comprises placing the reliably clean surface, the (formerly) interior surface 400, pointing upward with (formerly) exterior surface 410, the less reliably clean surface, pointed downward, touching the table, ground, etc. FIG. 6 shows box 200 after performing step 2040 and 2050. In general, those of ordinary skill in the art understand that the interior sides or surfaces of folded boxes are protected against some contamination because of how they are packaged. In some versions, box 200 contains printed matter on one or both of the interior surface and the exterior surface.

The method also comprises step 2060, placing the contents from box 200 onto the newly exposed clean surface of surface 400. At that point, the user can eat or play with the contents, step 2070.

The final step for this method is step 2080, which comprises disposing of box 200 after use.

While particular exemplars of the present invention have been shown and described, it will be obvious to those skilled in the art that changes and modifications can be made without departing from the exemplars of this invention in its broader aspects and, therefore, the appended claims are to encompass within their scope all such changes and modifications as fall within the true, intended, explained, disclose, and understood scope and spirit of this invention's multitudinous exemplars and alternative descriptions.

Additionally, various exemplars have been described above. For convenience's sake, combinations of aspects composing invention exemplars have been listed in such a way that one of ordinary skill in the art may read them exclusive of each other when they are not necessarily intended to be exclusive. But a recitation of an aspect for one exemplar is meant to disclose its use in all exemplars in which that aspect can be incorporated without undue experimentation. In like manner, a recitation of an aspect as composing part of an exemplar is a tacit recognition that a supplementary exemplar exists that specifically excludes that aspect. All patents, test procedures, and other documents cited in this specification are fully incorporated by reference to the extent that this material is consistent with this specification and for all jurisdictions in which such incorporation is permitted.

Moreover, some exemplars recite ranges. When this is done, it is meant to disclose the ranges as a range, and to disclose each and every point within the range, including end points. For those exemplars that disclose a specific value or condition for an aspect, supplementary exemplars exist that are otherwise identical, but that specifically exclude the value or the conditions for the aspect.

What is claimed is:

1. A method comprising:

providing a box comprising four walls with a corner where two walls connect, whereby the walls are a first wall, a second, wall, a third wall, and a fourth wall, whereby the first wall connects to the second wall at a first perforation, the second wall connects to the third wall at a second perforation, and the third wall connects to the fourth wall at a third perforation, and the first wall connects to the fourth wall at a glue line, bottom pieces connected to the walls that interlock with each other when the box is in a closed configuration, a top connected to the sides, and a handle attached to the sides, and contents disposed inside the box;

opening the top of the box;

opening or tearing the box along one of the corners creating a disconnection;

unfolding the box into a tray configuration such that the second wall and the third wall together form a floor of the tray configuration and the first wall, the fourth wall, and the bottom pieces together form a fence of the tray configuration; and arranging the box on a side with an interior surface pointing up and an exterior surface pointing down to form a tray.

2. The method of claim 1 further comprising removing the contents from the box.

3. The method of claim 1 wherein the disconnection is along the glue line.

4. The method of claim 3 further comprising placing the contents on the tray.

5. The method of claim 4 further comprising using the contents on the tray.

6. The method of claim 5 further comprising playing with the tray.

7. The method of claim 6 further comprising a third disposing of the tray.

8. The method of claim 7 wherein one of the interior surface or exterior surface comprises printed matter.

9. The method of claim 8 wherein both the interior surface and exterior surface comprise printed matter.

* * * * *